US009957619B2

(12) United States Patent
Kwak et al.

(10) Patent No.: US 9,957,619 B2
(45) Date of Patent: May 1, 2018

(54) PHOSPHATE SOLUTION FOR ZINC OR ZINC-BASED ALLOY PLATED STEEL SHEET, AND ZINC OR ZINC-BASED ALLOY PLATED STEEL SHEET USING THE SAME

(71) Applicant: POSCO, Pohang-si, Gyeongsangbuk-do (KR)

(72) Inventors: Young-Jin Kwak, Gwangyang-si (KR); Kyung-Hoon Nam, Gwangyang-si (KR); Yong-Hwa Jung, Gwangyang-si (KR); Tae-Yeob Kim, Gwangyang-si (KR); Dong-Yoeul Lee, Gwangyang-si (KR); Seok-Won Cho, Gwangyang-si (KR); Young-Ra Lee, Gwangyang-si (KR); Mun-Jong Eom, Gwangyang-si (KR); Woo-Sung Jung, Gwangyang-si (KR); Seok-Jun Hong, Gwangyang-si (KR); Jae-Kyu Min, Pohang-si (KR); Hong-Kyun Sohn, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 293 days.

(21) Appl. No.: 14/758,170

(22) PCT Filed: Dec. 28, 2012

(86) PCT No.: PCT/KR2012/011746

§ 371 (c)(1),
(2) Date: Jun. 26, 2015

(87) PCT Pub. No.: WO2014/104442

PCT Pub. Date: Jul. 3, 2014

(65) Prior Publication Data

US 2015/0329972 A1 Nov. 19, 2015

(30) Foreign Application Priority Data

Dec. 27, 2012 (KR) ..... 10-2012-0154286

(51) Int. Cl.

| | |
|---|---|
| ***C23C 18/16*** | (2006.01) |
| ***C23C 18/48*** | (2006.01) |
| ***C23C 18/31*** | (2006.01) |
| ***C23C 22/42*** | (2006.01) |
| ***C23C 28/00*** | (2006.01) |

(52) U.S. Cl.

CPC ..... *C23C 18/1637* (2013.01); *C23C 18/31* (2013.01); *C23C 18/48* (2013.01); *C23C 22/42* (2013.01); *C23C 28/321* (2013.01); *C23C 28/3225* (2013.01); *C23C 28/34* (2013.01); *Y10T 428/12667* (2015.01); *Y10T 428/12799* (2015.01)

(58) Field of Classification Search

CPC ..... C23C 18/1637; C23C 18/31; C23C 18/48
See application file for complete search history.

(56) References Cited

U.S. PATENT DOCUMENTS

| | | | |
|---|---|---|---|
| 4,961,794 | A | 10/1990 | Miyamoto et al. |
| 5,525,431 | A | 6/1996 | Kanamaru et al. |
| 6,861,160 | B2 | 3/2005 | Ando et al. |
| 2004/0112471 | A1 | 6/2004 | Moriya et al. |
| 2008/0207477 | A1 | 8/2008 | Kim et al. |
| 2008/0314479 | A1 | 12/2008 | Cape |

FOREIGN PATENT DOCUMENTS

| | | | | |
|---|---|---|---|---|
| CN | 1479806 | A | | 3/2004 |
| CN | 101109081 | A | | 1/2008 |
| EP | 1433879 | A1 | | 6/2004 |
| JP | 63-086875 | A | | 4/1988 |
| JP | 03-249180 | A | | 11/1991 |
| JP | 2624272 | B2 | * | 6/1997 |
| JP | 2002-206176 | A | | 7/2002 |
| JP | 2004-197143 | A | | 7/2004 |
| JP | 2005-126812 | A | * | 5/2005 |
| JP | 2006-077077 | A | | 3/2006 |
| JP | 2008-291162 | A | | 12/2008 |
| JP | 2009-256697 | A | | 11/2009 |
| JP | 2012-077322 | A | | 4/2012 |
| KP | 10-2011-0060352 | A | | 3/2011 |

(Continued)

OTHER PUBLICATIONS

International Search Report issued in International Application No. PCT/KR2012/011746 dated Jul. 3, 2013.
Extended European Search Report issued in European Application No. 12890712.8 dated Jan. 8, 2016.
"Electrolysis and Chemical Converted Film", Light Industry Press, Issued on Apr. 1987, pp. 218-220, with English Abstract.
Lin, B. et al., "The effect of sodium molybdate on the electrochemical behavior of surface print film of heat galvanized steel sheet", Materials Protection, vol. 39, No. 10, pp. 5-7, with English Abstract.
Dai, C. et al., "Film forming mechanism of calcium-modified phosphating coating on galvanized sheet", Electroplating and Environmental Protection, vol. 27, No. 6, pp. 26-29, with English Abstract.

(Continued)

*Primary Examiner* — Robert Harlan
(74) *Attorney, Agent, or Firm* — McDermott Will & Emery LLP

(57) ABSTRACT

A phosphate solution for a zinc or zinc-based alloy plated steel sheet, and a zinc or zinc-based alloy plated steel sheet using the same are provided. The phosphate solution for a zinc or zinc-based alloy plated steel sheet contains a molybdenum (Mo) ion, a calcium (Ca) ion and a phosphate ion. A zinc or zinc-based alloy plated steel sheet includes a base steel sheet, a zinc-based or zinc alloy-based plating layer formed on the base steel sheet, and a phosphate film formed on the zinc-based or zinc alloy-based plating layer. The phosphate film contains a molybdenum compound, Ca and a phosphate. A pitting phenomenon occurring at the time of treating a steel sheet with a phosphate is prevented, and excellent corrosion resistance is exhibited on a phosphate film.

9 Claims, 1 Drawing Sheet

(56) References Cited

FOREIGN PATENT DOCUMENTS

| | | | | |
|---|---|---|---|---|
| KR | 10-1994-0001032 | B1 | * | 2/1994 |
| KR | 1994-0001032 | | | 2/1994 |
| KR | 2003-0077545 | A | | 10/2003 |
| KR | 10-2011-0060352 | A | * | 6/2011 |
| KR | 10-2014-0083833 | A | | 7/2014 |
| WO | 02/046494 | A1 | | 6/2002 |
| WO | WO 02/046494 | A1 | * | 6/2002 |

OTHER PUBLICATIONS

Zhou, M. et al., "Comparing the Formation Process of Steel, Zinc, Aluminum, and Aluminum Alloy Phosphating Film", Issued on Aug. 1997, Shipbuilding Technology, vol. 8, pp. 34-38, with English Abstract.

Liu, Y., "Present Development of Phosphating Technology", Electroplating & Finishing, vol. 17, pp. 44-49, with English Abstract.

Chinese Office Action issued in Chinese Application No. 201280078061.9 dated May 11, 2016, with English Translation.

Japanese Office Action issued in Japanese Application No. 2015-551043 dated May 24, 2016, with English Translation.

* cited by examiner

| EXPERIMENTAL EXAMPLE | 1 | 2 | 3 | 4 |
|---|---|---|---|---|
| OCCURRENCE OF PITTING | 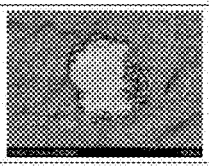 | 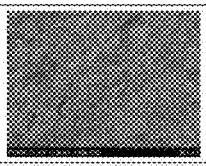 | 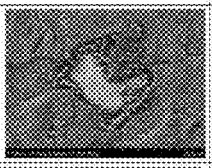 | 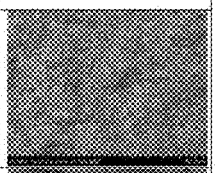 |
| CORROSION RESISTANCE | 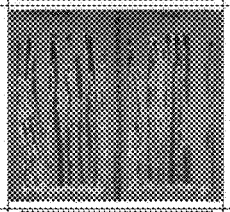 | 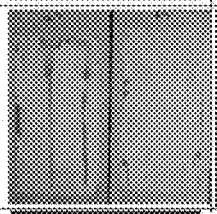 | 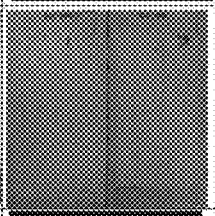 | 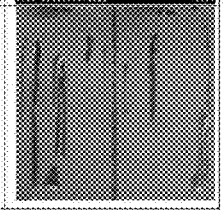 |
| WATERPROOFING ADHESION | 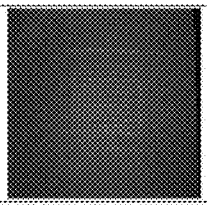 | 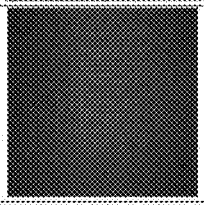 | 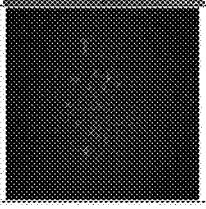 | 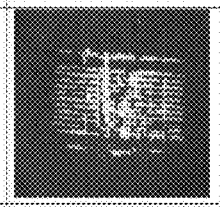 |
| EXPERIMENTAL EXAMPLE | 5 | 6 | 7 | 8 |
| OCCURRENCE OF PITTING | 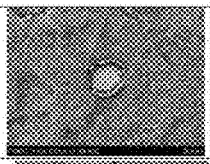 | 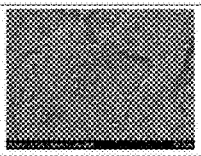 | 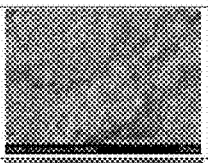 | 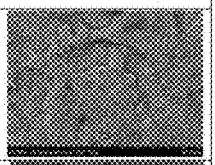 |
| CORROSION RESISTANCE | 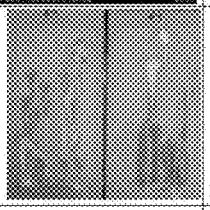 | 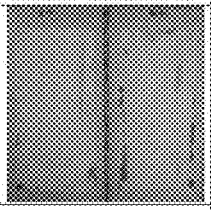 | 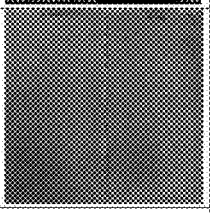 | 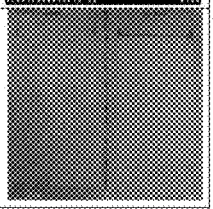 |
| WATERPROOFING ADHESION | 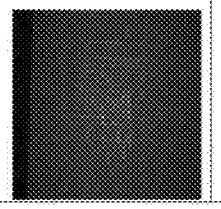 | 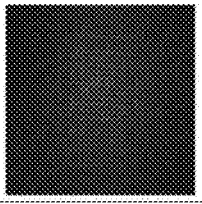 | 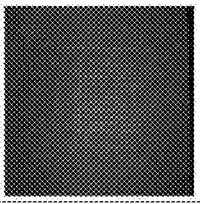 | 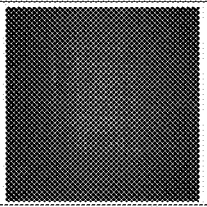 |

PHOSPHATE SOLUTION FOR ZINC OR ZINC-BASED ALLOY PLATED STEEL SHEET, AND ZINC OR ZINC-BASED ALLOY PLATED STEEL SHEET USING THE SAME

RELATED APPLICATIONS

This application is the U.S. National Phase under 35 U.S.C. § 371 of International Application No. PCT/KR2012/011746, filed on Dec. 28, 2012 which in turn claims the benefit of Korean Patent Application No. 10-2012-0154286 filed on Dec. 27, 2012, the disclosures of which the applications are incorporated by reference herein.

TECHNICAL FIELD

The present disclosure relates to a phosphate solution for a zinc or zinc-based alloy plated steel sheet, and a zinc or zinc-based alloy plated steel sheet using the same.

BACKGROUND ART

Phosphate coatings have been widely used in coating base steel sheets for use in the manufacturing of automobiles, home appliances, and the like. In the case of such plated steel sheets used in the manufacturing of automobiles, home appliances, and the like, since coating adhesion force is relatively low in the plated steel itself, a phosphate treatment is generally carried out to improve coating adhesion.

A mechanism of the formation of phosphate coating is that a plating layer melts on a portion of a coating object having positive polarity and an insoluble phosphate crystal is precipitated on a portion of a coating object having negative polarity. However, in a case in which a plating layer is damaged due to an excessive etching reaction in a phosphate solution treating process, the base steel sheet may be exposed, such that a pitting phenomenon may occur therein.

Patent Document 1 discloses that since chloride ions contained in a phosphate solution lead to the occurrence of such a pitting phenomenon, the content of chloride ions in a phosphate solution should be decreased in order to suppress the occurrence of pitting.

As such, the chloride ions contained in a phosphate solution further promote an etching reaction at the time of the formation of a phosphate film to thus increase the occurrence of pitting. Thus, in order to suppress the occurrence of pitting, a chloride ion concentration within the phosphate treatment solution needs to be significantly lowered, but since chloride ions are commonly present in city water supplies or a raw materials used when a phosphate solution is produced in the form of impurities, it may be difficult to appropriately adjust a chloride ion concentration.

Meanwhile, relatively low corrosion resistance of a phosphate film itself may cause a problem such as the corrosion of products while phosphate-treated products are being stored or transported, and a porous phosphate film may have inferior corrosion resistance. Therefore, technology for improving the corrosion resistance of a phosphate film through a separate sealing process using hexavalent chromium has been developed. However, as the use of hexavalent chromium is closely regulated due to environmental concerns, improvements in the corrosion resistance of a phosphate film through chromium sealing may not be obtained.

Accordingly, the development of a phosphate solution able to improve corrosion resistance while effectively suppressing pitting occurring due to chloride ions contained in a solution, without using hexavalent chromium, has been urgently demanded.

PATENT DOCUMENT (Patent Document 1): U.S. Pat. No. 4,961,794

DISCLOSURE

Technical Problem

An aspect of the present disclosure may provide a phosphate solution for a zinc or zinc-based alloy plated steel sheet, able to reduce a pitting phenomenon occurring in a phosphate film processing process and improve corrosion resistance of a phosphate film, and a zinc or zinc-based alloy plated steel sheet using the same.

Technical Solution

According to an aspect of the present disclosure, a phosphate solution for a zinc or zinc-based alloy plated steel sheet may include a molybdenum (Mo) ion, a calcium (Ca) ion, and a phosphate ion.

According to another aspect of the present disclosure, a zinc or zinc-based alloy plated steel sheet may include abase steel sheet; a zinc-based or zinc alloy-based plating layer formed on the base steel sheet; and a phosphate film formed on the zinc-based or zinc alloy-based plating layer. The phosphate film may contain a molybdenum compound, calcium (Ca) and a phosphate.

Advantageous Effects

According to an exemplary embodiment of the present disclosure, a phosphate solution able to prevent a pitting phenomenon occurring during the processing of a steel sheet with a phosphate and provide excellent corrosion resistance, and a zinc or zinc-based alloy plated steel sheet using the same may be provided.

DESCRIPTION OF DRAWINGS

FIG. 1 is images obtained by imaging surfaces of respective samples to determine whether or not pitting occurred in the samples and to evaluate corrosion resistance and waterproofing adhesion.

BEST MODE FOR INVENTION

Hereinafter, embodiments of the present disclosure will be described in detail with reference to the accompanying drawings. The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

According to an exemplary embodiment of the present disclosure, a phosphate solution for a zinc or zinc-based alloy plated steel sheet may contain a molybdenum (Mo) ion, a calcium (Ca) ion and a phosphate ion.

The Mo ion contained in the phosphate solution may be capable of suppressing a pitting phenomenon by lowering a rate of solution of a plating layer. In further detail, the Mo ion may be a compound exhibiting an effect of preventing metallic corrosion, may be contained in a phosphate solution to suppress an excessive etching reaction of a plating layer and so prevent the occurrence of a pitting phenomenon, and further, may also improve corrosion resistance of a phosphate film.

The Mo ion may be provided from a molybdenum compound introduced to a phosphate solution, and as the molybdenum compound, any molybdenum compound that can easily provide Mo ions may be used without particular limitation. For example, one or more selected from a group consisting of sodium molybdates, potassium molybdates, lithium molybdates, manganese molybdates, and ammonium molybdates may be used.

The Ca ion may be an element forming a scholzite phosphate crystal, improving corrosion resistance of a phosphate film through improved coating density, and improving heat resistance and waterproofing adhesion. According to an exemplary embodiment of the present disclosure, any material that can provide the Ca ion may be used without particular limitation. For example, one or more selected from a group consisting of calcium nitrates, calcium carbonates, calcium chlorides, calcium sulfides, calcium hydroxides, and calcium oxides may be used.

In addition, the phosphate solution according to an exemplary embodiment of the present disclosure may contain phosphate ions to improve coating adhesion of a plating layer, and as a material for providing the phosphate ions, a phosphate or the like may be used.

As such, as the phosphate solution according to the exemplary embodiment of the present disclosure contains an Mo ion and a Ca ion, a pitting phenomenon in which a plating layer is excessively etched at the time of performing a phosphate treatment on a zinc or zinc-based alloy plating steel sheet may be suppressed, and eco-friendly and economic characteristics and corrosion resistance may be improved by forming a phosphate film without a separate process such as a chromium sealing process being required.

On the other hand, in order to improve the above-described effects, the phosphate solution according to the exemplary embodiment of the present disclosure may contain an Mo ion in a range of 0.001~30 g/L, a Ca ion in a range of 0.1~3.0 g/L, and a phosphate ion in a range of 5~40 g/L. In a case in which the content of Mo ion is less than 0.001 g/L, an effect of suppressing a pitting phenomenon or improving corrosion resistance may not be sufficient, and in a case in which the content of Mo ion exceeds 30 g/L, a disadvantageous effect in which the size of a phosphate crystal is increased may be occur. In a case in which the content of the Ca ion is less than 0.1 g/L, an effect of improved corrosion resistance and waterproofing adhesion may not be sufficient, and in a case in which the content of the Ca ion exceeds 3.0 g/L, a problem that the size of a phosphate crystal and an adhesion amount of phosphate are increased and waterproofing adhesion is degraded may occur. In a case in which the content of phosphate ion is less than 5 g/L, the formation of a phosphate film may not be facilitated, and in a case in which the content of the phosphate ion exceeds 40 g/L, a problem relating to phosphate processing and solution stability may occur.

When the phosphate solution according to the exemplary embodiment of the present disclosure satisfies the component range described above, excellent pitting suppression and corrosion resistance effects may be secured, and in order to obtain a further improved effect, a Zn ion and a Mn ion may be additionally contained therein. The Zn ion and Mn ion contents may be within ranges of 0.3 to 3 g/L and 0.2 to 9 g/L, respectively. The Zn ion may be a principal element of a phosphate crystal, and may have an effect allowing for a phosphate film to be uniformly formed. For example, in a case in which the Zn ion is contained in an amount less than 0.3 g/L, the above-described effects may not be sufficient, and in a case in which the content of the Zn ion is more than 3 g/L, solution stability and phosphate processing may be deteriorated. The Mn ion exhibits improved effects such as fine phosphate crystal formation, increased corrosion resistance and increased alkali resistance, but in a case in which the Mn ion is contained in an amount of less than 0.2 g/L, the above described effects may not be sufficiently obtained, and in a case in which the Mn ion is contained in an amount of more than 9 g/L, the solution stability and the phosphate processing properties may be deteriorated.

On the other hand, since a Ni ion is an element increasing pitting at the time of the addition thereof, the phosphate solution according to an exemplary embodiment of the present disclosure may be characterized in that the Ni ion is not contained therein. However, in order to improve waterproofing adhesion, a small amount of Ni may also be added. In the exemplary embodiment of the present disclosure, the Ni ion may be contained in an amount of 0.5 g/L or less to improve waterproofing adhesion while significantly suppressing the occurrence of pitting by properly controlling the content of the Ni ion. In a case in which the Ni ion is present in an amount greater than 0.5 g/L, pitting may occur in a phosphate film and securing corrosion resistance may be difficult.

The phosphate solution according to an exemplary embodiment of the present disclosure may satisfy the composition as described above, and thus, when a zinc or zinc-based alloy plated steel sheet is treated with a phosphate, damage to a plating layer due to an excessive etching reaction may be prevented, such that the occurrence of pitting due to the steel sheet that may be exposed through the plating layer in a position in which the layer is not formed properly may be suppressed. In addition, a steel sheet may have an excellent degree of corrosion resistance and waterproofing adhesion after coating.

According to an exemplary embodiment of the present disclosure, a zinc or zinc-based alloy plated steel sheet treated with a phosphate using the phosphate solution described above may include a base steel sheet, a zinc-based or zinc alloy-based plating layer formed on the base steel sheet, and a phosphate film formed on the zinc-based or zinc alloy-based plating layer. The phosphate film may contain a molybdenum compound, calcium (Ca), and a phosphate.

In the case of a steel sheet provided according to an exemplary embodiment of the present disclosure, a type of a base steel sheet is not particularly limited, and any steel sheet that can be generally used in the art may be used. A plating layer formed on the base steel sheet of the present disclosure may be a Zn-based plating layer and may be configured of a Zn—Mg-based plating layer by additionally including Mg to improve corrosion resistance. The Mg may be an important element in improving corrosion resistance and may serve to promote the formation of a stable corrosion product in a corrosion environment by forming an intermetallic compound within the plating layer such that plating adhesion may be improved, as well as improving corrosion resistance of the plating layer. The content of Mg may be within a range of 3 to 30 wt %. In a case in which the content of Mg is less than 3 wt %, it may be difficult to obtain the above-described effect. In a case in which the content of Mg is more than 30 wt %, since a meltage in a plating bath may be increased to cause an increase in an amount of sludge, a degree of aging of the Mg may be rapidly progressed, thus deteriorating waterproofing adhesion. In this case, manufacturing costs may be further increased, as well as productivity degraded, due to the occurrence of a large amount of sludge. In further detail, the content of Mg may be within a range of 3 to 20 wt %. On the other hand, the plating layer may be formed using dry plating in consideration of the density or environmental friendliness of the plating layer, or the like.

The molybdenum compound may be $MoO_3$, and $MoO_3$ may improve corrosion resistance of a phosphate film through sealing of a porous phosphate film.

In addition, the Ca and the phosphate may have a form of scholzite ($Zn_2Ca(PO_4)_2.2H_2O$) film. The scholzite film may perform a role in improving corrosion resistance and waterproofing adhesion. In this case, in further detail, the scholzite film may contain Mg for further improving corrosion resistance and waterproofing adhesion. In the case of Mg, Mg eluted from the plating layer in a phosphate treatment process may participate in the formation of a phosphate crystal, or Mg may be directly added to the phosphate solution, such that Mg may be contained in the scholzite film.

In addition, in order to improve an effect of corrosion resistance, waterproofing adhesion after coating, and the like, the phosphate film may be adhered within a range of 1 to 5 g/m$^2$, and an average size of crystalline grains may be within a range of 1 μm to 10 μm. In a case in which the phosphate film is adhered in an amount of less than 1 g/m$^2$, an effect in which corrosion resistance of a steel sheet is improved may be degraded, and in a case in which the phosphate film is adhered in an amount greater than 5 g/m$^2$, workability and coating adhesion thereof may be deteriorated. Further, in a case in which the average size of crystalline grains within the phosphate film is less than 1 μm, corrosion resistance thereof may be degraded, and in a case in which the average size of crystalline grains within the phosphate film is more than 10 μm, workability and coating adhesion may be deteriorated.

In addition, the phosphate film may additionally contain Zn and Mn to thus form a Zn—Mn—PO-based crystal within the phosphate film, such that an excellent pitting suppression effect and corrosion resistance may be secured. On the other hand, the phosphate film may additionally contain Ni, and the Ni may form a Zn—Ni—PO-based crystal to thus improve waterproofing adhesion.

Hereinafter, an exemplary embodiment of the present disclosure will be described in more detail. However, the exemplary embodiments below are merely provided to describe the present disclosure in detail, and thus, do not limit the scope of the disclosure.

EXPERIMENTAL EXAMPLE

A Zn—Mg alloy plated steel sheet was cut into 70 mm×150 mm pieces and samples thereof were prepared. The samples were subjected to a phosphate treatment through processes of grease removing, rinsing, a surface treatment, a phosphate treatment, and rinsing. In this case, as a phosphate solution, a phosphate solution having a composition as illustrated in table 1 below was used. Regarding the phosphate-treated samples as above, whether or not pitting occurred, corrosion resistance, and waterproofing adhesion were evaluated, and subsequently, the results thereof are illustrated in table 1. Whether or not pitting occurred was determined by observing a sample surface using a SEM, the corrosion resistance was measured by performing a neutral salt spray test based on ASTM B117 and comparing corrosion occurrence areas after 24 hours had elapsed from the start of the neutral salt spray test. The samples were classified as grade 1 (defective) to grade 10 (good), depending on a degree of corrosion occurrence to then be evaluated. Waterproofing adhesion was evaluated by depositing the samples in water at 40° C. for 240 hours, subsequently performing crosscutting thereof, and performing a peel test thereon. The samples were classified as grade 1 (defective) to grade 10 (good) depending on a degree of peeling thereof. After the experimentation, images of surfaces of respective samples obtained by SEM are illustrated in FIG. 1.

TABLE 1

| | Content of Ion (g/L) | | | | | | Evaluation of Physical Properties | | |
|---|---|---|---|---|---|---|---|---|---|
| Division | $MoO_4$ | Ca | $PO_4$ | Zn | Mn | Ni | Whether or not pitting occurred | Corrosion Resistance | Waterproofing adhesion |
| Comparative Example 1 | — | — | 15 | 1.5 | 1.6 | 1.4 | ○ | 1 | 5 |
| Comparative Example 2 | 0.03 | — | 15 | 1.5 | 1.6 | 1.4 | x | 7 | 5 |
| Comparative Example 3 | — | 0.5 | 15 | 1.5 | 1.6 | — | ○ | 9 | 4 |
| Comparative Example 4 | — | — | 15 | 1.5 | 1.6 | — | x | 5 | 1 |
| Comparative Example 5 | — | — | 15 | 1.5 | 1.6 | 0.1 | ○ | 8 | 4 |
| Comparative Example 6 | 0.03 | — | 15 | 1.5 | 1.6 | 0.1 | x | 4 | 4 |
| Embodiment 1 | 0.03 | 0.5 | 15 | 1.5 | 1.6 | — | x | 10 | 5 |
| Embodiment 2 | 0.03 | 0.5 | 15 | 1.5 | 1.6 | 0.1 | x | 10 | 5 |

As illustrated in table 1 and FIG. 1, it can be appreciated that in the cases of Embodiment 1 and Embodiment 2 of the present disclosure in which a Mo ion and a Ca ion proposed by the present disclosure are contained in an appropriate range, pitting does not occur and furthermore, waterproofing adhesion is excellent. In detail, it can be appreciated therefrom that in the case of comparative example 2, since Ni, an element increasing pitting, is contained, but contained in an appropriate amount together with Mo and Ca ions, excellent corrosion resistance and waterproofing adhesion may be secured.

In the case of comparative example 1, since Mo ions and Ca ions were not contained therein, while Ni, an element increasing pitting, was contained therein, it can be appreciated that corrosion resistance and waterproofing adhesion were deteriorated as well as the occurrence of pitting.

In the case of comparative example 2, it can be appreciated that the occurrence of pitting was suppressed due to the addition of Mo ions thereto, while the degrees of corrosion resistance and waterproofing adhesion were relatively low due to lack of Ca therein.

In the case of comparative example 3, it can be appreciated that corrosion resistance and waterproofing adhesion were improved due to the addition of Ca ions thereto, while pitting occurred due to lack of Mo ions therein.

In the case of comparative example 4, it can be appreciated that although both of Mo and Ca ions were not contained therein, Ni was also not contained therein, and thus, pitting did not occur. However, as Mo and Ca ions proposed by the present disclosure were not contained therein, it was difficult to obtain excellent corrosion resistance and waterproofing adhesion.

In the case of comparative example 5, it can be appreciated that although Mo ions and Ca ions were not contained therein, corrosion resistance and waterproofing adhesion were improved due to the addition of Ni ions. However, pitting was not able to be suppressed due to the addition of Ni ions, leading to pitting.

In the case of comparative example 6, it can be appreciated that although Ni ions were contained therein, pitting was suppressed due to the addition of Mo ions. However, it could be seen that securing an excellent degree of corrosion resistance and waterproofing adhesion was difficult due to a lack of Ca ions.

The invention claimed is:

1. A zinc or zinc-based alloy plated steel sheet comprising:

a base steel sheet;

a zinc-based or zinc alloy-based plating layer formed on the base steel sheet; and a phosphate film formed on the zinc-based or zinc alloy-based plating layer, wherein the phosphate film contains a molybdenum compound, calcium (Ca) and a phosphate, and wherein the Ca and the phosphate are present as a scholzite film.

2. The zinc or zinc-based alloy plated steel sheet of claim 1, wherein the zinc-based or zinc alloy-based plating layer is a Zn—Mg-based plating layer.

3. The zinc or zinc-based alloy plated steel sheet of claim 2, wherein the Mg is contained in an amount of 3 to 30 wt %.

4. The zinc or zinc-based alloy plated steel sheet of claim 1, wherein the zinc-based or zinc alloy-based plating layer is formed using a dry plating process.

5. The zinc or zinc-based alloy plated steel sheet of claim 1, wherein the molybdenum compound is MoO3.

6. The zinc or zinc-based alloy plated steel sheet of claim 1, wherein the scholzite film contains magnesium (Mg).

7. The zinc or zinc-based alloy plated steel sheet of claim 1, wherein the phosphate film is adhered in a range of 1 to 5 g/m2, and an average size of crystalline grains is in a range of 1 to 10 μm.

8. The zinc or zinc-based alloy plated steel sheet of claim 1, wherein the phosphate film additionally contains Zn and Mn.

9. The zinc or zinc-based alloy plated steel sheet of claim 1, wherein the phosphate film additionally contains Ni.

* * * * *